United States Patent [19]

Ducellier

[11] 4,438,712

[45] Mar. 27, 1984

[54] STITCHING HEAD HAVING TWO INDEPENDENT PRESSER FEET

[75] Inventor: Hugues, J. M. Ducellier, Mesnil Saint Pere, France

[73] Assignee: Broderie De Mesnil St Pere S.A.R.L., Troyes, France

[21] Appl. No.: 326,338

[22] Filed: Dec. 1, 1981

[30] Foreign Application Priority Data

Dec. 10, 1980 [FR] France ..... 80 26231

[51] Int. Cl.[3] ..... D05B 29/06; D05B 53/00

[52] U.S. Cl. ..... 112/100; 112/236

[58] Field of Search ..... 112/236, 100, 101, 235

[56] References Cited

U.S. PATENT DOCUMENTS

| | | | |
|---|---|---|---|
| 300,434 | 6/1884 | Baker | 112/101 |
| 376,860 | 1/1888 | Cornely | 112/100 |
| 1,707,068 | 3/1929 | Rubel | 112/100 |
| 2,968,267 | 1/1961 | Johnson | 112/235 |

FOREIGN PATENT DOCUMENTS

| | | | |
|---|---|---|---|
| 32845 | of 0000 | Fed. Rep. of Germany | 112/100 |
| 595538 | 3/1934 | Fed. Rep. of Germany | 112/100 |
| 2419342 | 11/1979 | France | 112/235 |

*Primary Examiner*—Werner H. Schroeder
*Assistant Examiner*—Andrew M. Falik
*Attorney, Agent, or Firm*—Warren B. Kice

[57] ABSTRACT

A stitching head for a stitching or embroidering machine for forming stitches fixed to the machine by a support including at least one needle which is associated with a main presser foot having a pressing heel. The stitching head has an auxiliary presser foot which is independent of the main presser foot and has a heel pierced with an opening. The auxiliary presser foot is mounted for sliding, with respect to the support, along an axis parallel to the needle, whereby its heel is disposed in the path of the downward movement of the main presser foot parallel to and spaced apart from the pressing heel of the main presser foot, while having its opening situated in the path of the needle. A helical spring is mounted for permanently urging the auxiliary presser foot toward the main presser foot.

15 Claims, 5 Drawing Figures

STITCHING HEAD HAVING TWO INDEPENDENT PRESSER FEET

The present invention relates to a stitching head for a stitching or embroidering machine, more particularly for forming loop stitches and comprising, for securing it to the machine, a support in which at least one needle slides associated with a main presser foot having a pressing heel.

Textile articles, such as T-shirts or pullovers, decorated with loop-stitch patterns, are valued highly by the public, and in particular by young people.

Different types of machines are known capable of forming stitches of this kind. They all have in common a relatively complicated structure and are consequently relatively expensive. If we add thereto the fact that their stitching head is designed to form exclusively loop stitches, it will be readily understood that investment in such machines cannot be economical for small textile firms, whose activities are generally directed to traditional embroidery and much less frequently to loop-stitch embroidery. The result is that these firms are often restrained in their desire to diversify their production.

The present invention proposes remedying these disadvantages by providing a stitching head for a stitching or embroidering machine wherein the stitching head is characterized by an auxiliary presser foot having a heel pierced with at least one opening. This auxiliary presser foot is mounted for sliding with respect to the stitching head support along an axis parallel to the needle in a position such that its heel is disposed in the path of the downward movement of the main presser foot, parallel to and spaced apart from the pressing heel thereof, while its opening is situated in the path of a respective needle. Return means are provided for permanently urging the auxiliary presserfoot toward the main presser foot.

With these arrangements, it will be understood that when the stitching head of the invention is mounted in a stitching or embroidering machine, the heel of the auxiliary presser foot is disposed between that of the main presser foot and the workplate of the machine.

Thus, during its downward travel, the main presser foot drives along with it the auxiliary presser foot which is automatically returned to its rest position when the main presser foot is raised. Consequently, if a thick thread is engaged in the opening of the heel of the auxiliary presser foot, this thread will form, during reciprocal motion of the main presser foot, a loop which will be fixed by means of a seam formed by the needle.

It will be noted that the stitching head of the invention may be formed by a simple adaptation of a traditional stitching head. It may furthermore, if the auxiliary presser foot is not provided with a thread, operate as a traditional stitching head, which considerably increases its economy of operation.

In a first embodiment of the invention, more particularly intended for single-needle machines, the auxiliary presser foot is formed by an arm parallel to the needle, the lower end of this arm being curved in the direction of this latter so as to form the heel.

In a second embodiment of the invention, more especially designed for use in multi-needle machines, the auxiliary presser foot is formed from two arms parallel to the needle and coupled together, at their lower end, by means of a flat crosspiece which forms the heel.

Advantageously, means are provided for adjusting the height, in the rest position, of the heel of the auxiliary presser foot.

More precisely, these means are formed by at least one microjack with adjustable travel mounted above a respective arm of the auxiliary presser foot, its rod being directed towards the corresponding arm parallel thereto. It will be understood that these means serve to adjust height.

Furthermore, a second micro-jack is mounted above each arm of the auxiliary presser foot, the maximum travel of its rod being such that, when the stitching head is mounted in the machine, it may bring the heel of the auxiliary presser foot practically in contact with the workplate thereof. This second micro-jack allows the auxiliary presser foot to be permanently held in contact with the piece of material to be embroidered, which enables lock stitches to be formed.

The present invention also relates to a stitching or embroidering machine equipped with a stitching head such as described above.

Two embodiments of the present invention will be described below by way of nonlimiting examples with reference to the accompanying drawing in which.

Figure 1:
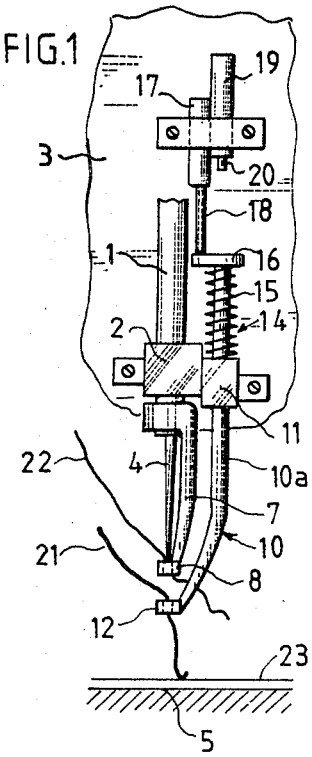
FIG. 1 is a front view of a first embodiment of the stitching head of the invention in its rest position.

The first embodiment of the stitching head of the invention, shown in FIG. 1, comprises in a way known per se a needle-holder 1 mounted for sliding inside a sleeve 2 forming a support for fixing the stitching head to the frame 3 of a stitching machine (not shown).

Figure 2:
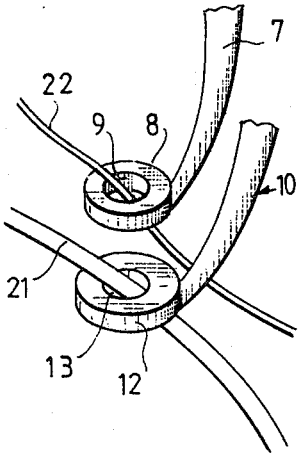
FIG. 2 is an enlarged perspective view of a detail of the stitching head of FIG. 1.

On the needle-holder 1 is mounted a needle 4 which extends perpendicularly to the workplate 5 of the stitching machine as well as a presser foot 7, named hereafter "main presser foot", mounted in a way known per se on the needle-holder 1. The main presser foot carries at its free end a pressing heel 8 having pierced therethrough a hole 9 (see FIG. 2) disposed in the travel path of needle 4. The means for moving needle-holder 1 and the main presser foot 7, which means are of a known type, have not been shown in the figures.

According to its first characteristic, the stitching head of the invention comprises an auxiliary presser foot 10. This latter is mounted, independently of the main presser foot 7, for sliding along an axis parallel to needle 4, inside a second sleeve 11 integral with sleeve 2 of needle-holder 1. The auxiliary presser foot 10 is formed from an arm **10*a* parallel to needle 4 and whose lower end, which is curved in the direction of this latter, carries a heel 12 having therethrough a hole 13 of small diameter (see FIG. 2). The fitting of the auxiliary presser foot 10 with respect to the main presser foot 7 is such that its heel 12 is disposed in the path of the downward movement of the main presser foot 7, parallel to and spaced apart from the pressing heel 8 of this latter, while having its opening 13 situated in the path of needle 4. Once the stitching head is mounted on the machine, heel 12 is situated between the workplate 5 of this latter and the pressing heel 8 of main presser foot 7**.

Still with reference to FIG. 1, return means 14 are provided for urging the auxiliary presser foot 10 permanently towards the main presser foot 7. These return means 14 are formed by a helical spring 15 mounted about the arm 10*a* of presser foot 10, between a flange 16 provided at the upper end of the latter and sleeve 11.

With this set of arrangements, it will be understood that, during the downward travel of needle-holder 1, the main presser foot 7 drives the auxiliary presser foot 10 downwards through its pressing heel 8. If the main presser foot 7 is raised, spring 15 instantaneously brings the auxiliary presser foot 10 back to its rest position.

It will be further noted that an adjustable-travel micro-jack 17 is mounted above arm 10*a* of the auxiliary presser foot 10 so that its rod 18 is directed towards flange 16 of the latter parallel to arm 10*a*. As can be clearly seen in the figures, rod 18 of jack 17 serves as a stop for limiting the return travel of the auxiliary presser foot 10. By adjusting the travel of the piston rod 18, the height, with respect to plate 5, of the heel 12 of the auxiliary presser foot 10 in the rest position is thus adjusted in a simple way.

It can be seen in the figures that a second micro-jack 19 with longer travel is mounted along the first one, above flange 16 of the auxiliary presser foot 10. When it is completely extended, the rod 20 of this second micro-jack brings and holds the heel 12 of auxiliary presser foot 10 practically in contact with plate 5. The utility of this latter arrangement will be seen further on. The two jacks 17 and 19 are fixed to the frame 3 of the machine or firmly secured to sleeves 2 and 11 (not shown).

The formation of loop stitches in a piece of material, by means of the above-described stitching head, is effected in the following way.

At first, a thick thread 21, which is engaged in the opening 13 of the heel 12 of the auxiliary presser foot 10 is sewn by needle 4 on the piece of material 23.

Assuming that the two presser feet 7 and 10 are in mutual contact on the piece of material 23, the needle-holder 1 and the main presser foot 7 are raised by means well known in the art which are incorporated in the top part of the stitching head. The two feet are then out of contact and the auxiliary presser foot 10 is returned to its rest position by spring 15. The rest position of the auxiliary presser foot 10 is determined by the micro-jack 17 and 18. The thick thread 21 forming loops is in sliding engagement with the opening 13 of the heel 12 of the auxiliary presser foot 10 during the raising movement of the presser feet. A thin sewing thread 22 is further engaged in the opening 9 of the pressing heel of the main presser foot 7 and in the eye of needle 4.

Figure 3:
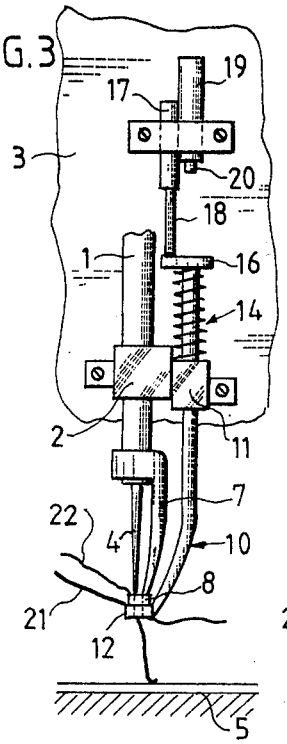
FIGS. 3 and 4 are front views of the stitching head of FIG. 1 in two successive operating positions.
Figure 4:
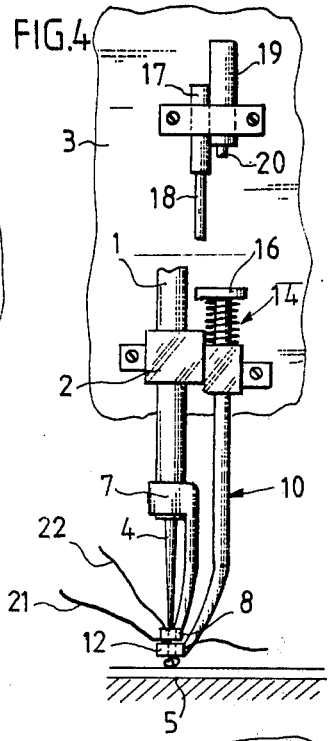

In the following step, main presser foot 7 is lowered simultaneously with the needle-holder 1. As soon as its heel 8 comes into contact with the heel 12 of the auxiliary presser foot 10 (FIG. 3), and during the remaining downward movement of the main presser foot 7 which drives the auxiliary presser foot 10 against the action of spring 15, the thick thread 21 is nipped between the two heels 8 and 12. Pressed downward and secured against sliding engagement within opening 13 of heel 12, thick thread 21 is turned down to form a loop. As soon as the two presser feet 7 and 10 are in contact with piece of material 23 (see FIG. 4), needle 4 is actuated to form a stitch for securing the loop on the piece of material by means of the thin thread 22. Thus, the loop is sewn on the piece of material by needle 4. It should be mentioned here, that, for reasons relating to the density of the loops, the row of stitching is preferably formed in a herring bone pattern.

With this row of stitching formed, the needle-holder 1 is raised and the auxiliary presser foot 10 is returned to its rest position by spring 15. During this return movement, the thick thread 21 slides in the opening 13 of heel 12 to create slack for forming a new loop. The piece of material is slightly advanced and a new loop may be formed by repeating the cycle described above.

It will be noted here that adjustments of the high position of auxiliary presser foot 10 by means of micro-jack 17 determines the height given to the loops. Micro-jacks 17 and 19 are of conventional pneumatic or hydraulic type and the stroke of their rods 18 and 20, respectively, is determined by an appropriate adjustment of the supplied fluid.

This height may be reduced to a minimum if the piston rod 20 of the second above-mentioned micro-jack 19 is placed in its maximum travel. In this case in fact, the heel 12 of the auxiliary presser foot 10 is permanently in contact with the piece of material 23 and there is obtained, in the place of loops, stitched-thread embroidery of the "Kordel" type.

It will also be noted that if no thread is engaged in opening 13 of the auxiliary presser foot 10, the stitching head of the invention may be used for forming conventional sewing or embroidering stitches. In this case, the piston rod 18 of micro-jack 17 will be completely retracted so as to bring the auxiliary presser foot 10 into its maximum high position and thus free, thereunder, a passage sufficiently open for inserting the piece of material. This arrangement may also be provided at each pause at the end of loop embroidery.

It can then be seen that the stitching head of the invention may have numerous applications without for requiring any adaptation or transformation. It may then show a maximum profitability and it is this which forms its great advantage. Furthermore, it will be noted that the stitching head of the invention may be advantageously formed by a very simple modification of a conventional stitching head.

Figure 5:
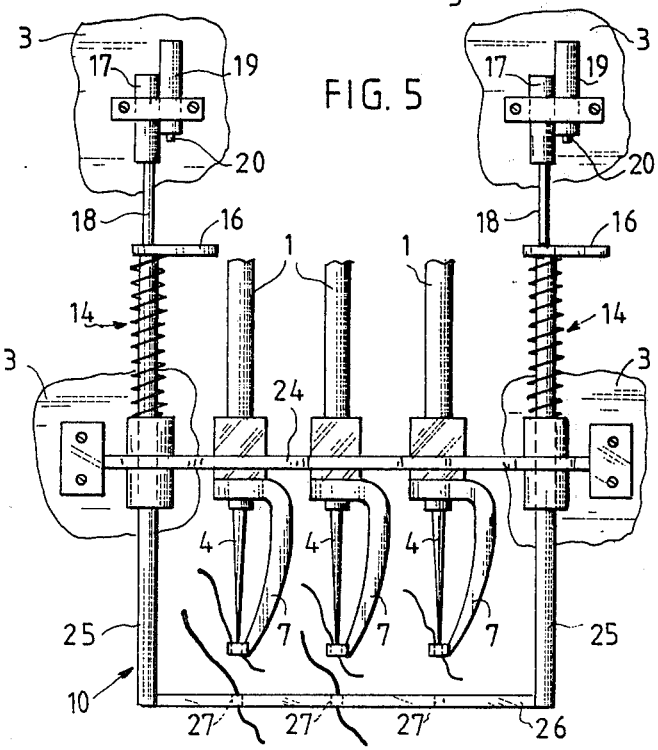
FIG. 5 is a front view of a second embodiment of the stitching head of the invention in its rest position.

FIG. 5 shows, seen from the front, a second embodiment of the stitching head of the invention. This is in fact a head having a plurality of needles 4, aligned or disposed along an arc of a circle, for forming multicolor embroideries. In this second embodiment, the stitching head comprises a support bar 24 in which slide the different needle-holders 1. Its auxiliary presser foot 10 is further formed from two arms 25 parallel to the needles, disposed on each side thereof, and connected at their lower end by means of a flat crosspiece 26 forming a heel which fulfills the same function as heel 12 of the first embodiment. The crosspiece 26 has pierced therein openings 27 each associated with a needle 4. It will be further noted that in this second embodiment the arms 25 of the auxiliary presser foot 10 are each associated with a spring 15, and with first and second micro-jacks 17 and 19 identical to those of the first embodiment.

With this second embodiment of the stitching head of the invention, multicolor loop stitches may be formed and even conventional embroidery stitches associated with loop stitches.

I claim:

1. A stitching head for a stitching or embroidering machine having a workplate on which a piece of material may be advanced, said stitching head comprising a support for fixing said stitching head to the machine above the workplate; at least one sewing needle which is slidably mounted in said support; a main presser foot having a pressing heel which is pierced with at least one hole disposed in the path of said sewing needle; means cooperating with said main presser foot for continuously and automatically forming upwardly directed loops with a thread on said piece of material, said loop forming means raising a given length of said thread previously secured to said peice of material during each upward movement of the main presser foot, and nipping said length of said thread during each subsequent downward movement of the main presser foot in order to turn it down and form a loop which is thereafter secured on the piece of material through a stitch made by said sewing needle.

2. A stitching head according to claim 1 in which said loop forming means comprises an auxiliary presser foot having a heel pierced with at least one hole, the diameter of which is smaller than the size of the heel of said main presser foot but larger than the diameter of said thread which is designed to be inserted in said hole, said auxiliary presser foot being mounted for sliding, with respect to the support, along an axis parallel to the sewing needle, the heel of said auxiliary presser foot being disposed in the path of the downward movement of the main presser foot, between the workplate and the heel of the main presser foot while having its hole situated in the path of said sewing needle; and return means for permanently urging auxiliary presser foot towards the main presser foot, so that the auxiliary presser foot is lifted by said return means during each upward movement of the main presser foot, while raising said thread which slides in the hole of said auxiliary presser foot heel, whereas the main presser foot pushes the auxiliary presser foot toward the workplate, during each subsequent downward movement of the main presser foot, whereby said thread is nipped between the heels of main and auxiliary presser feet to be turned down and form a loop.

3. A stitching head according to claim 2, in which the auxiliary presser foot comprises an arm parallel to the needle, the lower end of the arm being curved in the direction of the needle for forming the heel of the auxiliary presser foot, said return means comprising a helical spring mounted about said arm between a fixed sleeve in which said arm slides and a flange formed on the upper end of said arm.

4. A stitching head according to claim 2, in which the auxiliary presser foot is formed from two arms parallel to the needle and connected at their lower end by a flat crosspiece which forms the heel.

5. A stitching head according to claim 3 or 4, in which the return means comprise a helical spring mounted about each of said arms between a fixed sleeve in which the respective arm slides and a flange formed on the upper end of that respective arm.

6. The stitching head according to claim 5 further comprising means for adjusting the height in the rest position of the heel of the auxiliary presser foot.

7. The stitching head as claimed in claim 6 in which said adjusting means comprises at least a first adjustable-travel micro-jack mounted above a respective arm of the auxiliary presser foot, the rod of the micro-jack being directed towards the corresponding arm parallel thereto.

8. The stitching head according to claim 5 in which a second micro-jack is mounted above each arm of the auxiliary presser foot, the maximum travel of its rod being such that, when the stitching head is mounted in the machine, it may bring the heel of the auxiliary presser foot practically in contact with the plate of the machine.

9. The stitching head according to claim 6 in which a second micro-jack is mounted above each arm of the auxiliary presser foot, the maximum travel of its rod being such that, when the stitching head is mounted in the machine, it may bring the heel of the auxiliary presser foot practically in contact with the plate of the machine.

10. The stitching head according to claim 7 in which a second micro-jack is mounted above each arm of the auxiliary presser foot, the maximum travel of its rod being such that, when the stitching head is mounted in the machine, it may bring the heel of the auxiliary presser foot practically in contact with the plate of the machine.

11. A stitching head according to claim 3 or 4 further comprising means for adjusting the height in the rest position of the heel of the auxiliary presser foot.

12. A stitching head as claimed in claim 4 in which the adjustment means comprises at least a first adjustable-travel micro-jack mounted above a respective arm of the auxiliary presser foot, the rod of this microjack being directed towards the corresponding arm parallel thereto.

13. The stitching head according to claim 11 in which a second micro-jack is mounted above each arm of the auxiliary presser foot, the maximum travel of its rod being such that, when the stitching head is mounted in the machine, it may bring the heel of the auxiliary presser foot practically in contact with the plate of the machine.

14. The stitching head according to claim 12 in which a second micro-jack is mounted above each arm of the auxiliary presser foot, the maximum travel of its rod being such that, when the stitching head is mounted in the machine, it may bring the heel of the auxiliary presser foot practically in contact with the plate of the machine.

15. A stitching head according to claim 3 or 4 in which a second micro-jack is mounted above each arm of the auxiliary presser foot, the maximum travel of its rod being such that, when the stitching head is mounted in the machine, it may bring the heel of the auxiliary presser foot practically in contact with the plate of the machine.

* * * * *